US005364179A

United States Patent [19]

Brüstle et al.

[11] Patent Number: 5,364,179

[45] Date of Patent: Nov. 15, 1994

[54] CLOSING DEVICE FOR DRAWERS

[75] Inventors: Klaus Brüstle, Höchst; Helmut Hollenstein, Lustenau, both of Austria

[73] Assignee: Julius Blum Gesellschaft m.b.H., Höchst, Austria

[21] Appl. No.: 991,552

[22] Filed: Dec. 15, 1992

[30] Foreign Application Priority Data

Dec. 24, 1991 [AT] Austria ..... 2563/91

[51] Int. Cl.[5] ..... A47B 88/00

[52] U.S. Cl. ..... 312/333; 312/334.47

[58] Field of Search ..... 312/334.14, 334.7, 334.44, 312/334.46, 334.47, 333

[56] References Cited

U.S. PATENT DOCUMENTS

| | | | |
|---|---|---|---|
| 1,238,514 | 8/1917 | Hartbeck . | |
| 1,241,093 | 9/1917 | Collings . | |
| 2,450,593 | 10/1917 | Hormes . | |
| 2,873,159 | 2/1959 | Becker . | |
| 3,055,724 | 7/1962 | Mazure . | |
| 3,836,222 | 9/1974 | Kuntze . | |
| 3,975,071 | 8/1976 | Quinn . | |
| 5,040,858 | 8/1991 | Kruse et al. . | |
| 5,207,781 | 5/1993 | Rock | 312/334.7 |

FOREIGN PATENT DOCUMENTS

| | | |
|---|---|---|
| 0386731 | 9/1990 | European Pat. Off. . |
| 0391221 | 10/1990 | European Pat. Off. . |
| 1262533 | 12/1959 | Germany . |
| 3010089 | 9/1981 | Germany . |
| 9007365.7 | 8/1991 | Germany . |
| 1117071 | 6/1968 | United Kingdom . |
| 1137872 | 12/1968 | United Kingdom . |

*Primary Examiner*—Kenneth J. Dorner
*Assistant Examiner*—Gerald Anderson
*Attorney, Agent, or Firm*—Wenderoth, Lind & Ponack

[57] ABSTRACT

On each side of a drawer is a pull-out rail secured to the drawer and a support rail secured to a furniture body. Load-transmitting rollers are mounted between the rails. Provided on one side of the drawer is a closing device including a guide housing mounted on the body and having a guide groove to guide a plate-shaped tilt segment which is acted upon by a spring. The tilt segment is displaceable along the guide grooves by guide pegs extending into the guide groove. An entrainer peg on the drawer couples to the tilt segment. The guide groove is arranged in the guide housing on a side thereof facing the support rail. The tilt segment projects laterally from the guide housing and has two laterally projecting stabilizing pegs which, in end positions of the tilt segment, fit on and abut support surfaces of the guide housing on a side thereof remote from the guide groove.

17 Claims, 7 Drawing Sheets

CLOSING DEVICE FOR DRAWERS

BACKGROUND OF THE INVENTION

The invention relates to a closing device for a drawer, there being provided on each side of the drawer a pull-out rail secured to the drawer and a support rail secured to a furniture carcass or body, and load-transmitting rollers or the like bearing on or between the rails. A closing device is provided on at least one side of the drawer and includes a guide housing, preferably mounted on the body, and which has a guide groove for a plate-shaped tilt segment or tiltable member which is acted upon by a spring and which is displaceable along the guide groove means of guide pegs extending into the guide groove. When the tiltable member is displaced in a pull-out direction of the drawer, it is coupled to an entrainer peg or pin member, which is preferably on the drawer. The tilt segment is acted on by a restoring-ensuring means, i.e. the spring, and is arranged in the guide housing on a side thereof facing a mounting surface therefor, for example the support rail, and is guided therein in concealed manner but projects laterally therefrom.

Modern drawers are provided with a pull-out guide fitting which on both sides of the drawer comprises a body or carcass-side support rail and a drawer-side pull-out rail and is intended to make the displacement movement of the drawer as smooth as possible. For transmission of load between the drawer-side pull-out rails and the carcass-side support rails, rollers, balls or indeed slides can be provided, depending on the requirements of the drawer regarding quiet running and load.

It has been found that in some cases a closed drawer does not retract completely into the rear end position, that is to say into the body, and a front panel of the drawer projects forwardly of the furniture body. This can result in bumping against the drawer, which in turn can result in personal injury or damage to the drawer.

The fact that the front panel of the drawer protrudes from the furniture front can be the consequence of the drawer having been pushed in carelessly and not fully into the furniture body. However, if the drawer is pushed into the furniture body with too much force, as well, the drawer can roll forwardly again as a result of such excess energy.

British Patent Specification 1 117 071 discloses a device for keeping a drawer closed, in which a tilt part movable between two end positions is provided. The tilt part is acted upon by a helical spring and is urged thereby into a respective end position after overcoming a dead center position. The tilt part is secured to a side wall of the furniture body. The drawer has on the side wall an entrainer peg which is retracted in the end region of the travel of the drawer into a notch in the tilt part. Then, the entrainer peg presses the tilt part beyond the dead center position, whereupon the tilt part itself disengages from the entrainer peg and thus pulls the drawer backwards.

EP-A1-0 391 221 discloses a closing device for a drawer, in which a tilt segment, which is acted upon by a tension spring, is moved linearly in a guide groove in a pull-out direction in order then to tilt into a front locking position. Thus, the drawer is entrained a further distance by the closing device.

SUMMARY OF THE INVENTION

It is the object of the present invention to provide an improved closing device of the type described above, but whereby with a plastic guide housing improved stable guidance and support of the tilt segment in the rear position thereof are achieved.

In accordance with the invention, this object is achieved in that the tilt segment has at least one laterally projecting stabilizing peg or member which, at least in an end position of the tilt segment, fits over and abuts a support surface of the guide housing on the side of the guide housing remote from the tilt segment.

Advantageously, it is provided for there to be constructed on the tilt segment adjacent the or one of the stabilizing pegs a resilient tab over which the entrainer peg can pass in the push-in direction of the drawer, but which is caught by the entrainer peg in the pull-out direction such that the tilt segment is moved by the pull-out direction such that the tilt segment is moved by the entrainer peg as far as the front end position of the tilt segment. As a result, the tilt segment, if it was drawn into its rear position unintentionally by the tension spring when the drawer was extended, can be brought back into the front locking position by a single closing and pulling out of the drawer. During this, the closing device remains fully functional.

A further feature of the invention provides that the tension spring acts eccentrically on the tilt segment and is guided linearly in a channel in the guide housing that extends parallel to the guide groove. The spring is received in concealed manner in such channel. The spring force exerted on the tilt segment is thus very even. There is no abrupt exertion of force, and nor does any dead center position have to be overcome.

BRIEF DESCRIPTION OF THE DRAWINGS

An embodiment of the invention will be described below with reference to the accompanying drawings, wherein.

DETAILED DESCRIPTION OF THE INVENTION

Figure 1:
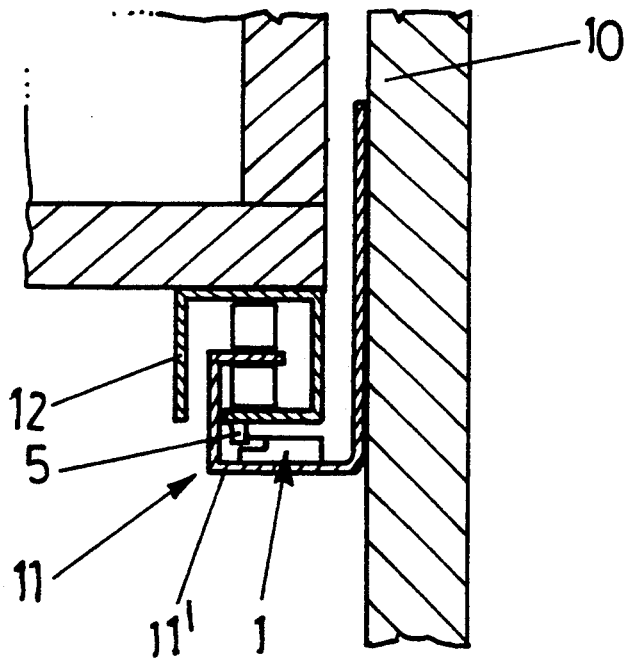
FIG. 1 is a diagrammatic section through a drawer and a furniture body side wall, a closing device also being shown.

Provided on each side of a drawer is a pull-out guide fitting including a support rail 11 secured to a carcass or body side wall 10 and a pull-out rail 12 secured to the drawer. Between the pull-out rail 12 and the support rail 11 there is a carriage (not shown in the drawings) in which load-transmitting rollers are mounted.

Figure 9:
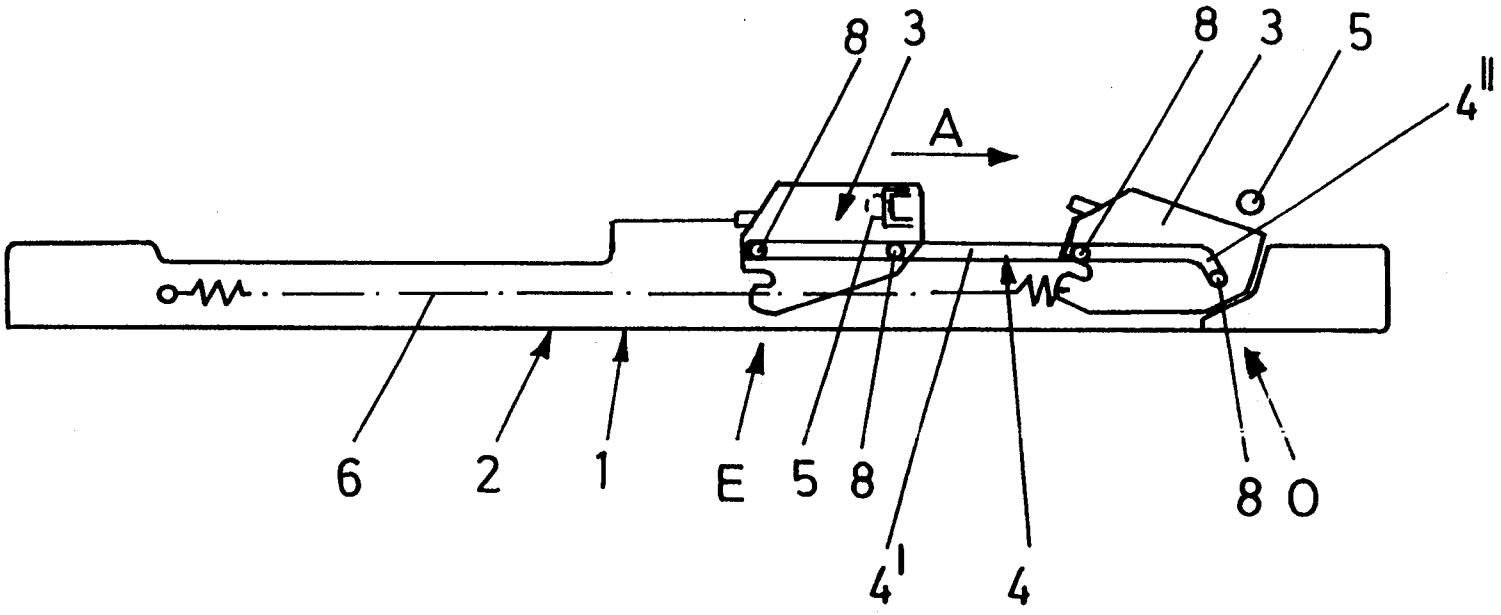
FIG. 9 is a schematic view of the guide housing with the tilt segment and cooperation thereof with an entrainer peg.

A closing device 1 is mounted on at least one support rail 11. The essential parts of the closing device 1 are a guide housing 2, a tilt segment or tiltable member 3, a guideway 4 and a tension spring 6, which is a helical spring. The guideway 4 is formed by a groove located in the guide housing 2. An entrainer peg or pin member 5 is arranged directly on the drawer-side pull-out rail 12 of the pull-out guide fitting. The tilt segment 3 is guided in the guideway 4 by means of two pegs 8 projecting from segment 3 into guideway 4. The guideway 4 has a rear long straight section 4' and a front arcuate section 4" (FIG. 9). A rear end of spring 6 is suspended by a peg of the guide housing 2 and a front end of the spring is suspended on segment 3.

Figure 2:
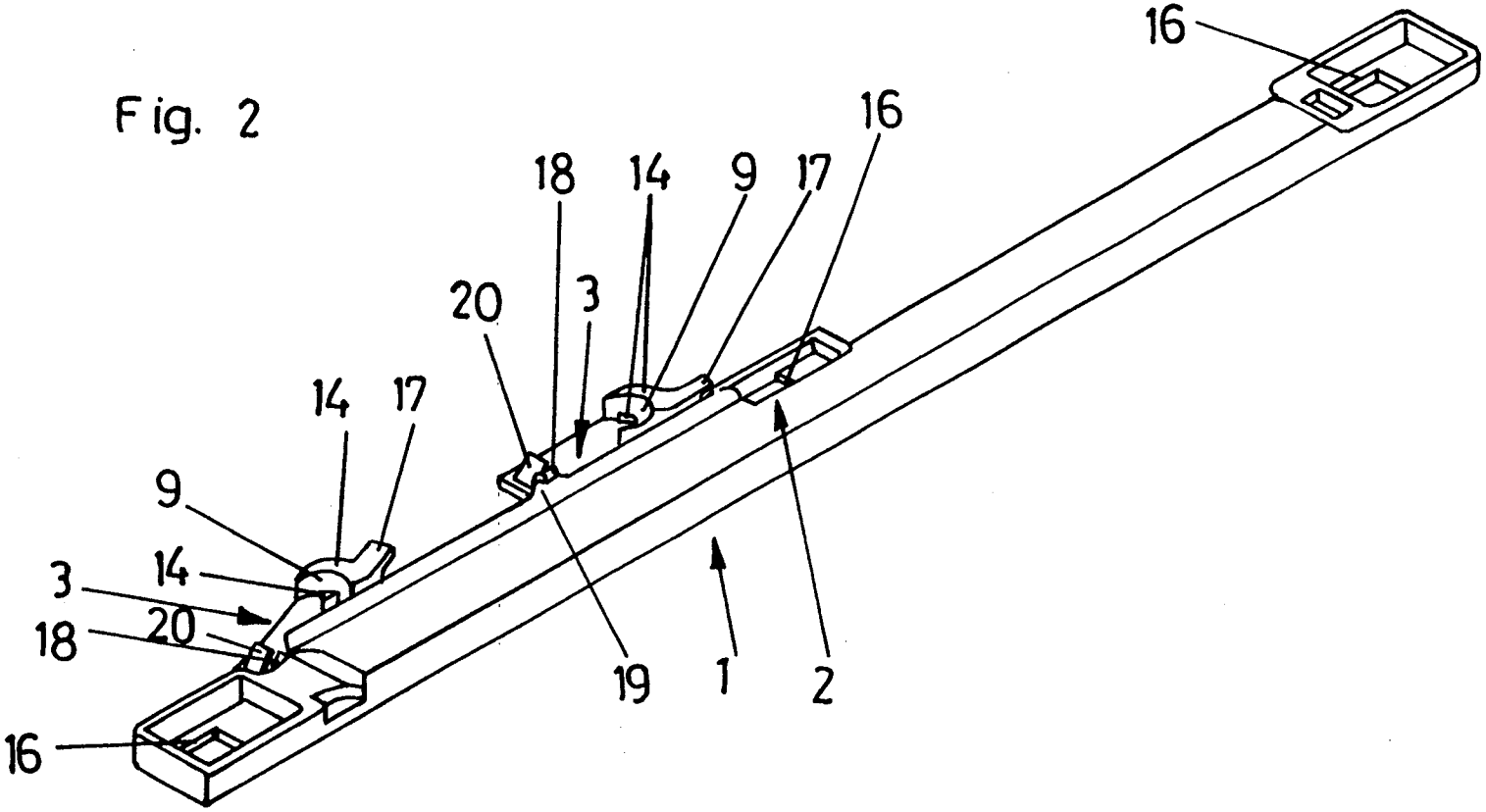
FIG. 2 is a perspective view of a guide housing and a tilt segment of the closing device.
Figure 3:
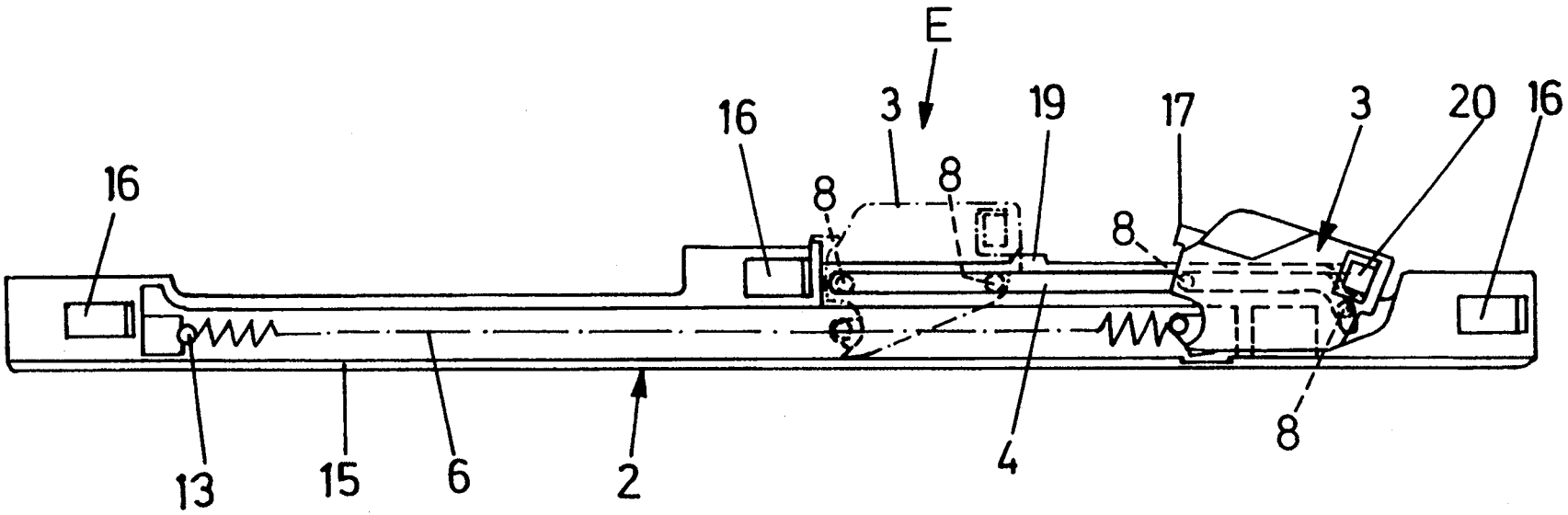
FIG. 3 is a bottom view of the guide housing, the tilt segment being shown in two end positions thereof.
Figure 6:
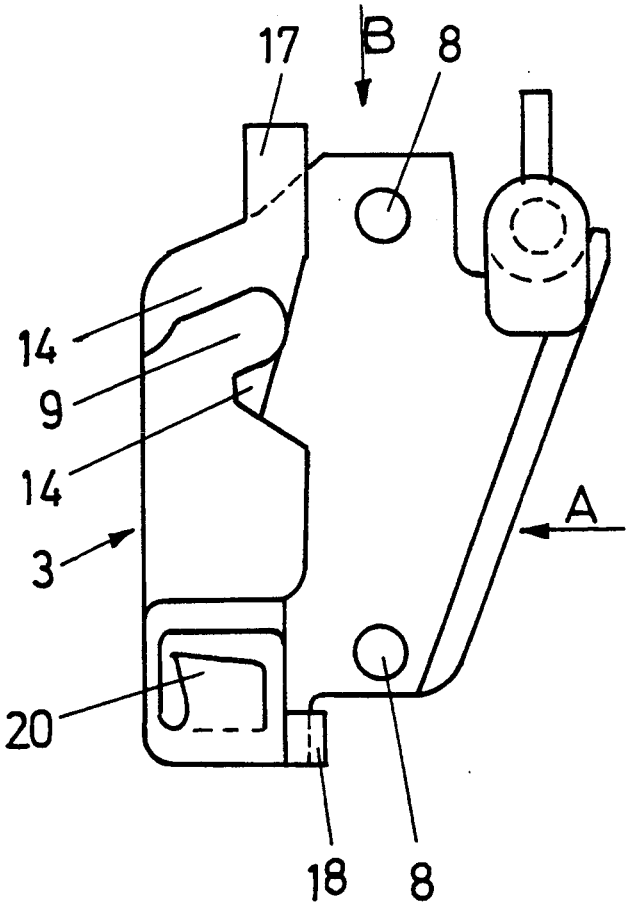
FIG. 6 is a plan view of a tilt segment.
Figure 7:
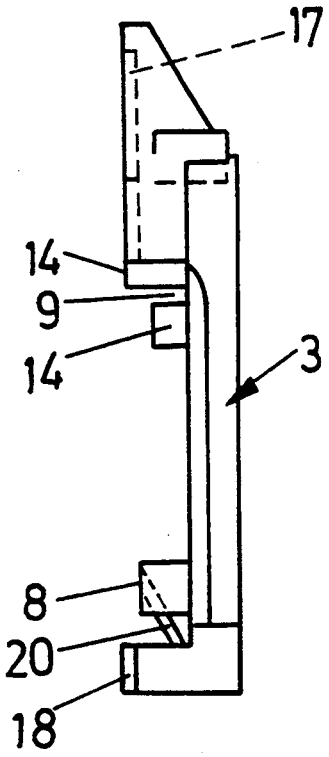

When the drawer is pushed in, the tilt segment 3 is in the position designated E in FIGS. 3 and 9, and the entrainer peg 5 projects into an upwardly open slot 9 of the tilt segment 3 (FIG. 2). The slot 9 is in this case delimited by two projections or blocks 14 (FIG. 6). When the drawer is opened, the tilt segment 3 is moved along the straight section 4' of the guideway 4 in the direction of the arrow A (FIG. 9) until it reaches the arcuate section 4' the guideway 4. There, as shown in FIG. 9, the tilt segment 3 is tilted forwardly, such that further outward movement of the drawer causes the entrainer peg 5 to be moved out of the slot 9 and thus released from tilt segment 3. As a result of the guidance provided between both the pegs 8 and the dimension of the arc of the section 4", the tilt segment 3 is locked in its front position when the drawer is extended, that is to say, segment 3 is not automatically retracted by the spring 6.

When the drawer then again is pushed in, it is moved freely over the first part of the displacement path until the entrainer peg 5 again latches into the slot 9 of the tilt segment 3. As a result of the pushing force of the entrainer peg 5, the tilt segment 3 is tilted rearwardly out of its locked position. As soon as the tilt segment 3 has been moved out of the arcuate section 4" and is in the straight section 4' of the guideway 4, the spring 6 comes into effect. That is to say, whereas the tilt segment 3 was first moved by the movement of the drawer, the spring force of the spring 6 can now be transmitted to the drawer by way of the tilt segment 3 and the entrainer peg 5, so that the spring 6 pulls the drawer fully into the furniture body with the tilt segment 3. In this manner, the drawer is pulled completely into the furniture carcass or body even if it is pushed in with little care, and the drawer panel is prevented from projecting forwardly from the furniture body.

Figure 4:
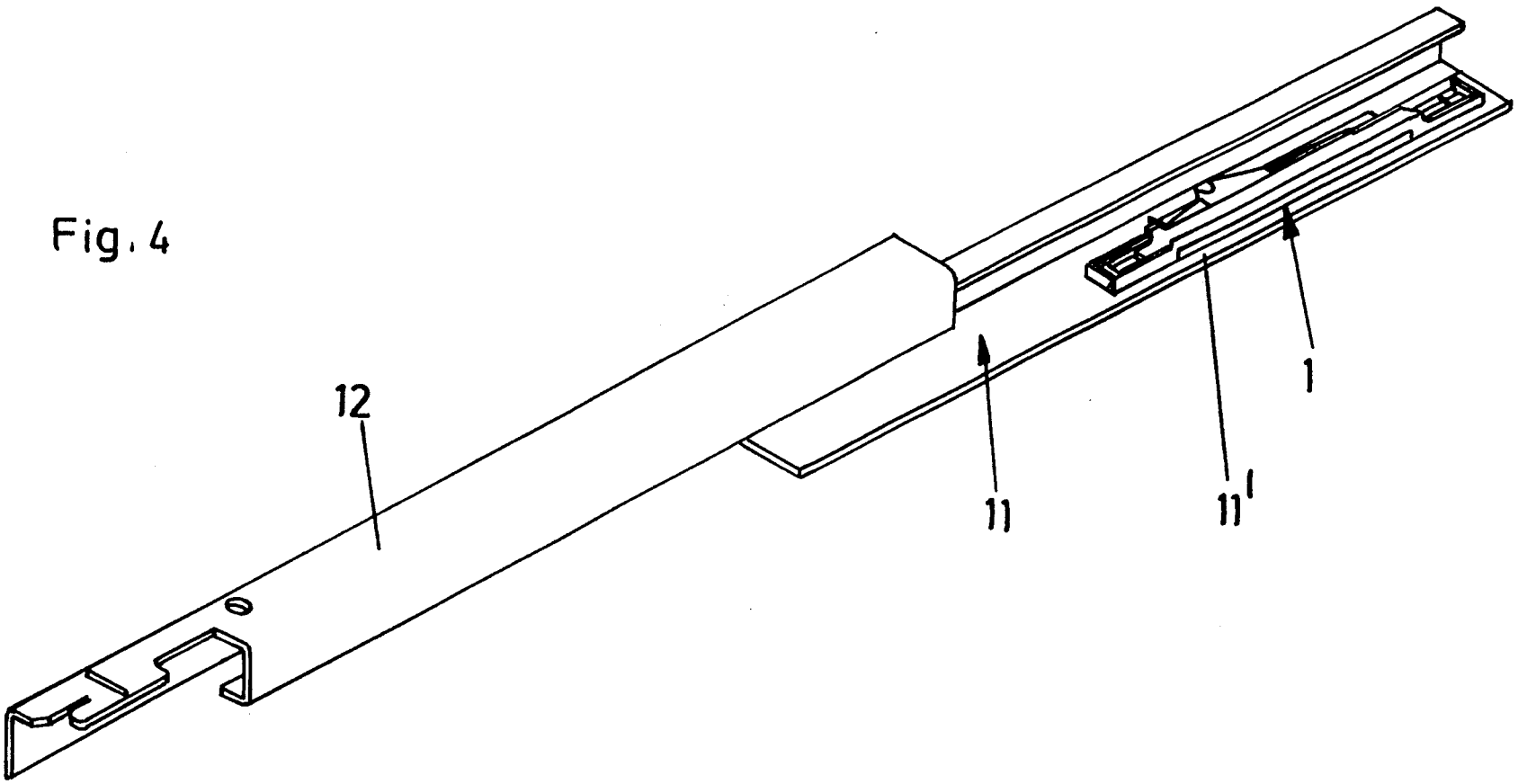
FIG. 4 is a perspective view of support and pull-out rails and the closing device.

The closing device 1 and thus the guide housing 2 are mounted on a lower horizontal web 11' of the support rail 11 (FIG. 4). The guide groove 4 is located on the underside of the guide housing 2, and the tilt segment 3 is arranged below the guide housing 2, that is to say it is located between the guide housing 2 and the web 11' of the support rail 11.

Parallel to the guide groove 4, but projecting further rearwardly, is a channel 15 which receives the tension spring 6. The tension spring 6, which is completely covered by the guide housing 2, is merely extended and then contracts again with the restoring motion of the drawer. The spring does not cause tilting movement of tilt segments.

The tilt segment 3 is substantially covered by the guide housing 2 (FIG. 3). Only a small part of segment 3 projects laterally from the guide housing 2 alongside the guide groove 4.

Figure 5:
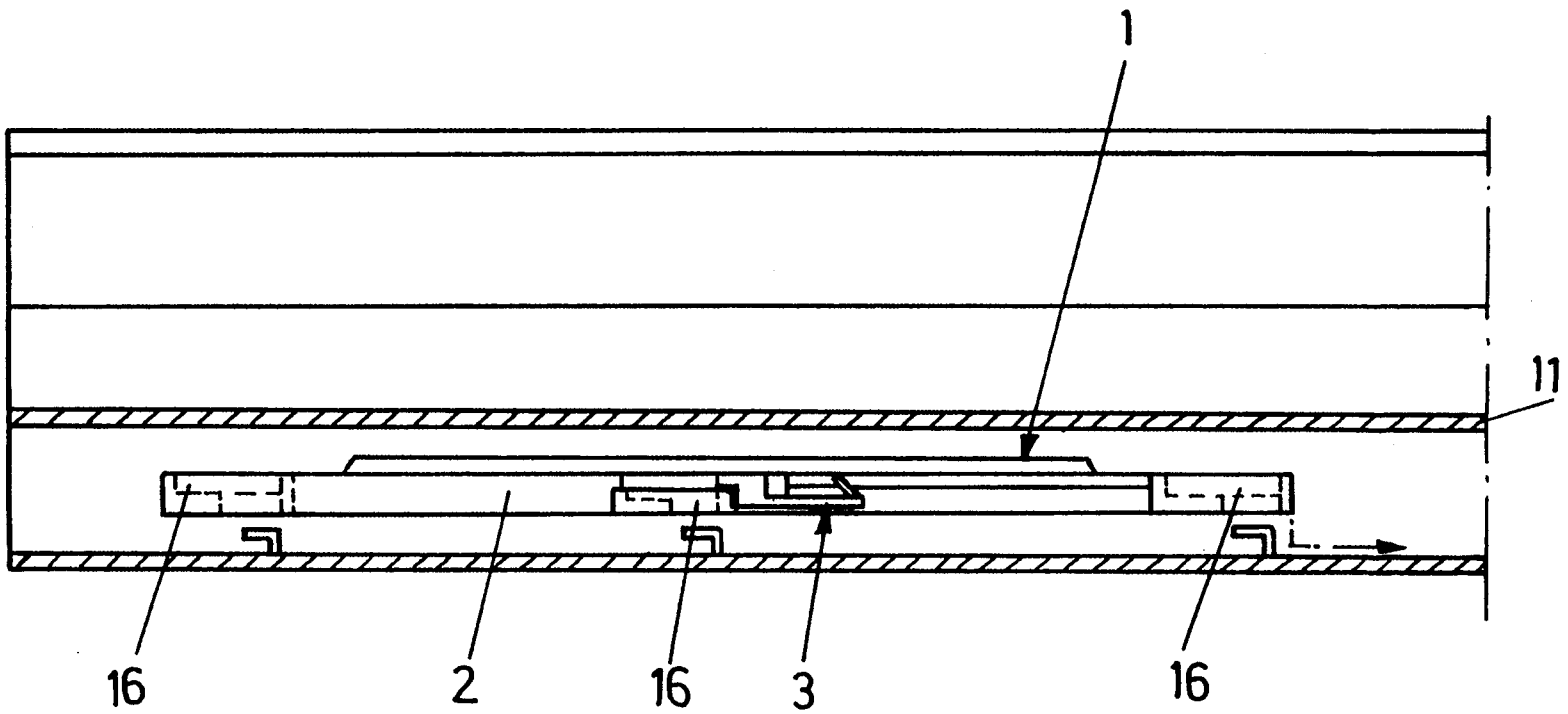
FIG. 5 is a side view, partially in section, of the support rail and of a closing device according to the invention during assembly.
Figure 8:
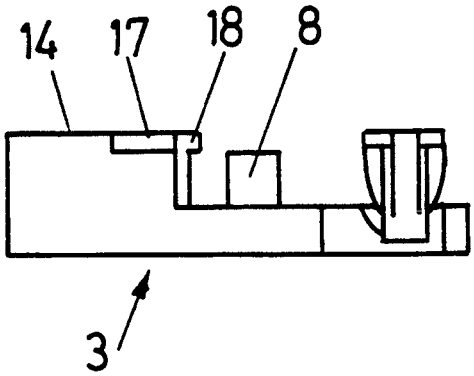
FIGS. 7 and 8 are views of the tilt segment as seen from the directions of arrows A and B, respectively, in FIG. 6.

The guide housing 2 has three securing points 16 which are preferably located at least approximately at the same spacing from one another (FIGS. 2 and 5). In this way, necessary stability can be achieved even with a guide housing 2 formed of relatively thin plastic material.

In order to improve the guidance and mounting of the tilt segment 3, at least in the two end positions thereof, in accordance with the invention, tilt segment 3 has two laterally extending stabilizing projections or pegs 17, 18. The stabilizing pegs 17, 18 reach over and abut top surfaces of the guide housing 2, thus stabilizing the position of segment 3. For this purpose, there is constructed on the guide housing 2 next to the guide groove 4 a protuberance 19 over which the stabilizing peg 18 fits in the rear end position of tilt segment 3.

Next to the stabilizing peg 18 on the tilt segment 3 is a resilient tab 20. If the tilt segment 3 has unintentionally been pulled out of its front position by the spring into the rear end position E when the drawer is opened, the entrainer peg 5 on pull-out rail 12 can pass over tab 20 when the drawer is closed. When the drawer is opened again, the entrainer peg 5 catches tab 20 and thus entrains the tilt segment 3 into the front end position, whereat peg 5 is then unlatched from tab 20. The next time the drawer is pushed in, the tilt segment 3 becomes fully functional again and receives the entrainer peg 5 in the slot 9.

We claim:

1. A closing device, for use in an article of furniture having furniture components including a furniture body and a drawer slidable in opposite directions into and out of the body, for moving the drawer into a fully inserted position within the body, said device comprising:

a guide housing having a first side to face a mounting surface of one of the furniture components on which said guide housing is to be mounted, a second side remote from said first side, and a guide groove formed in said first side;

a plate-shaped tiltable member having guide pegs, said tiltable member being positioned on said first side of said guide housing with said guide pegs extending into said guide groove, such that said tiltable member is displaceable relative to said guide housing in opposite directions along said guide groove between opposite end positions of said tiltable member;

a restoring member operable between said guide housing and said tiltable member to urge said tiltable member in a first said direction to a first said end position, whereby said tiltable member is movable in a second said direction along said guide groove against the urging force of said restoring member upon movement of the drawer outwardly of the furniture body; and said tiltable member having a portion projecting laterally of said guide housing, said portion having extending therefrom at least one stabilizing projection that, at least at one said end position of said tiltable member, fits over and abuts a support surface on said second side of said guide housing, thereby stabilizing said tiltable member relative to said guide housing.

2. A device as claimed in claim 1, wherein said laterally projecting portion of said tiltable member has a part to be engaged by movement of the drawer outwardly of the furniture body, thereby causing movement of said tiltable member in said second direction.

3. A device as claimed in claim 2, further comprising a pin member to be mounted on the other furniture component, and said part defines a slot in said tiltable member, said pin member being received in said slot.

4. A device as claimed in claim 3, wherein said guide groove includes a rectilinear portion and an arcuate end portion, said pin member fitting in said slot when said guide pegs of said tiltable member fit in said rectilinear portion, and when at least one of said guide pegs fit in said arcuate portion said tiltable member being tilted relative to said guide housing into a locked second end position whereat said pin member is released from said slot.

5. A device as claimed in claim 4, wherein said laterally projecting portion of said tiltable member has extending therefrom a resilient tab that is bendable by contact with said pin member upon inward movement of said drawer and that has a configuration to be abutted and pulled along by said pin member upon subsequent outward movement of the drawer.

6. A device as claimed in claim 5, wherein said resilient tab extends at an angle inclined to the plane of said plate-shaped tiltable member.

7. A device as claimed in claim 5, wherein said resilient tab is located adjacent said stabilizing projection.

8. A device as claimed in claim 1, wherein said tiltable member, other than said laterally projecting portion thereof, is concealed by said guide housing, when viewed from said second side thereof.

9. A device as claimed in claim 1, wherein said laterally projecting portion of said tiltable member has extending therefrom two stabilizing projections.

10. A device as claimed in claim 9, wherein said two stabilizing projections extend in directions substantially at right angles to each other.

11. A device as claimed in claim 1, wherein said support surface on said second side of said guide housing is formed on a protuberance extending laterally from said guide housing.

12. A device as claimed in claim 1, wherein said restoring member comprises a tension spring having first and second opposite ends connected respectively to said guide housing and to said tiltable member.

13. A device as claimed in claim 12, wherein said tension spring is housed in a channel formed in said guide housing.

14. A device as claimed in claim 13, wherein said channel extends parallel to said guide groove and is spaced therefrom, and said second end of said tension spring is connected to said tiltable member within said channel, such that the force of said spring acts on said tiltable member eccentrically of the direction of movement of said guide pegs in said guide groove.

15. A device as claimed in claim 1, wherein said guide housing is elongated and has spaced longitudinally therealong plural securing devices to secure said guide housing to the mounting surface of the one furniture component.

16. A device as claimed in claim 15, comprising three said securing devices spaced at approximate equal longitudinal intervals.

17. A device as claimed in claim 1, further comprising a support rail of a pull-out guide fitting and to be mounted on the furniture body, said guide housing being mounted on said support rail.

* * * * *